US008016045B2

(12) United States Patent
Milthorpe

(10) Patent No.: US 8,016,045 B2
(45) Date of Patent: Sep. 13, 2011

(54) METHOD AND APPARATUS FOR DISTRIBUTING PARTICULATE MATTER

(76) Inventor: Rodney Milthorpe, Rutherglen (AU)

( * ) Notice: Subject to any disclaimer, the term of this patent is extended or adjusted under 35 U.S.C. 154(b) by 0 days.

(21) Appl. No.: 12/438,541

(22) PCT Filed: Aug. 24, 2007

(86) PCT No.: PCT/AU2007/001223

§ 371 (c)(1),
(2), (4) Date: Jun. 17, 2009

(87) PCT Pub. No.: WO2008/022403

PCT Pub. Date: Feb. 28, 2008

(65) Prior Publication Data

US 2009/0260840 A1 Oct. 22, 2009

Related U.S. Application Data

(60) Provisional application No. 60/823,393, filed on Aug. 24, 2006.

(51) Int. Cl.
*E02F 3/76* (2006.01)

(52) U.S. Cl. ..... 172/817

(58) Field of Classification Search ..... 37/217, 37/231–236, 266, 263, 272–277; 172/811, 172/815–819

See application file for complete search history.

(56) References Cited

U.S. PATENT DOCUMENTS

| | | | | | |
|---|---|---|---|---|---|
| 1,021,928 | A * | 4/1912 | Hayward | 37/217 |
| 3,021,622 | A * | 2/1962 | Whittier | 37/366 |
| 3,907,143 | A * | 9/1975 | Brown et al. | 414/705 |
| 4,189,854 | A | 2/1980 | Haynes | |
| 4,306,625 | A | 12/1981 | Davis | |
| 4,821,810 | A | 4/1989 | Buchanan | |
| 5,974,702 | A * | 11/1999 | Donoghue | 37/263 |
| 6,948,268 | B1 | 9/2005 | Ronca | |
| 6,983,558 | B2 * | 1/2006 | Haas | 37/269 |

FOREIGN PATENT DOCUMENTS

| | | | |
|---|---|---|---|
| JP | 11-313509 | A | 11/1999 |
| WO | WO 91/07547 | A | 5/1991 |

* cited by examiner

*Primary Examiner* — Robert E Pezzuto
(74) *Attorney, Agent, or Firm* — Woodcock Washburn LLP

(57) ABSTRACT

Embodiments of the present invention provide a method and apparatus for distributing particulate matter over a surface by spreading. The apparatus for distributing particulate matter over a surface is adapted to be fitted to a prime mover. The apparatus includes a mounting frame for attaching the apparatus to the prime mover, at least one grading blade carried by the mounting frame and mounted moveable laterally sideways relative to the prime mover and an actuator to controllably move the grading blade to move the grading blade substantially sideways relative to the prime mover. The lateral sideways movement of the apparatus relative to prime mover enables particulate matter to be moved independent of the direction of travel of the prime mover.

17 Claims, 11 Drawing Sheets

METHOD AND APPARATUS FOR DISTRIBUTING PARTICULATE MATTER

PRIORITY CLAIM TO RELATED U.S. APPLICATIONS

To the fullest extend permitted by law, the present United States Non-Provisional Patent Application is a U.S. National Phase Filing of and with priority to Patent Cooperation Treaty Application No. PCT/AU2007/001223, entitled, "Method and Apparatus for Distributing Particulate Matter," filed on behalf of inventor, Rodney Milthorpe on Aug. 24, 2007, which claims priority to and the benefit of United States Provisional Patent Application entitled "Method and Apparatus for Distributing Particulate Matter," filed on Aug. 24, 2006, and having assigned Ser. No. 60/823,393, incorporated herein by reference.

FIELD OF THE INVENTION

The field of the invention is in relation to a method and apparatus for distributing particulate matter, such as earth, crushed rock, sand, and in particular grading. One particular example of an application for the present invention is precision grading of packing sand for the subsequent laying of concrete.

BACKGROUND OF THE INVENTION

When a surface needs to be levelled such as for laying a slab of concrete, building a road, landscaping or the like, earth moving equipment is generally used to minimise the amount of manual labour required. Earth moving equipment conventionally comprises a motorised prime mover, self propelled on wheels or tracks and one or more hydraulically driven working arms to which tools such as diggers, buckets, dozing blades, or grading blades are attached to perform their respective functions.

The working arms can move only in the vertical plane to enable the entire arm or the articulated portions arm to be raised and lowered vertically relative to the prime mover to adjust the height and angle in the vertical plane of the tool attached to the arm. Movement of the tool in the horizontal plane, in particular sideways movement and large movements forward and backward are only achieved by movement of the prime mover with the arm and tool attached. Hydraulic or mechanical controls may be provided for operating the tools, such as for opening and for closing dampers or crushers.

The equipment and attached tools enable the majority of heavy work to be performed, however finishing and precise work has generally required significant manual labour. A recent development in grading equipment, for spreading particulate matter such as sand, soil, crushed rock etc, is a laser grading system. In this development the level of a grading blade is automatically adjusted, based on a reference datum from a laser, in order to dynamically adjust the amount of particulate matter being deposited or moved to maintain a level surface of grading. Although the adjustment of the height of the blade should correlate to the amount of particulate matter being deposited or moved, the amount of particulate matter actually deposited can vary based on the weight of the particulate matter or the amount of the particulate matter accumulated on the grading blade, so the end result is not a perfectly level surface. Further, the manoeuvrability of the equipment can limit the area accessed by the grader blade such that significant manual work is then still required for levelling areas not reached and/or for correcting other levelling errors to finish the job.

SUMMARY OF THE INVENTION

According to one aspect of the present invention there is provided an apparatus for distributing particulate matter over a surface, said apparatus being adapted to be fitted to a prime mover, the apparatus comprising:

- a mounting frame for attaching the apparatus to the prime mover;
- at least one grading blade carried by the mounting frame and mounted to be moveable laterally sideways relative to the prime mover; and
- an actuator to controllably move the grading blade to move the grading blade laterally sideways relative to the prime mover.

Preferably the apparatus includes two grading blades joined at an angle of or less than 90° to form a nose at the forward end of the apparatus relative to the mounting frame.

In one preferred embodiment each grading blade has a vertical grading component that is concave. In another embodiment each grading blade has a left hand side grading face and a right hand side grading face and wherein each grading face has a vertical grading component that is concave.

The apparatus can further comprise one or more auxiliary grading blades mounted between the grading blade and the mounting frame.

Preferably all the grading blades are mounted on a grading blade frame which is pivotally mounted relative to the mounting frame by a pivot such that the actuator causes the grading blade frame to swing about the pivot to move the grading blades laterally sideways relative to the prime mover.

An example of a suitable actuator is a hydraulic ram.

The grading blade frame can have apertures proximate each auxiliary grading blade to enable a portion of the particulate matter being graded to pass therethrough.

In an embodiment of the apparatus the grading blade is provided with apertures to enable a portion of the particulate matter being graded to pass therethrough.

According to another aspect of the present invention there is provided a method for spreading particulate matter over a surface comprising the steps of:

- providing one or more first prime movers each with at least one grading blade;
- positioning the grading blade in engagement with the particulate matter; and
- moving the grading blade laterally sideways relative to the prime mover to move the particulate matter independent of movement of the prime mover.

Optionally the method further comprises using two grading blades on the apparatus, each blade being joined at, or relative to the mounting frame, at or less than 90° to form a nose at a forward end of the apparatus: the step of positioning the grading blade into a corner using a lateral sideways movement of the grading blade; and

- moving the prime mover in a direction substantially parallel to a wall forming the corner to spread particulate matter evenly along an edge of the wall from the corner.

An example of an application of the method as described above is to spread particulate matter over a surface to be substantially level to prepare a surface area for further grading using a second prime mover provided with a precision grading apparatus. The prepared surface area can be graded using a precision grading tool of the second prime mover to provide a precision graded area. The further step of grading an area adjacent the precision graded area not graded by the second prime mover using one or more of the first prime movers may be applied. The level of the adjacent area can be graded substantially level with the precision graded area based on the level of the precision graded area.

According to another aspect of the present invention there is provided a method of spreading particulate matter over a surface comprising the steps of:

- providing one or more first prime movers each with at least one grading blade;
- positioning the grading blade in engagement with the particulate matter;
- moving the prime mover to move the particulate matter to be substantially level to prepare a surface area for further grading;
- precision grading the prepared surface area using a second prime mover provided with a precision grading apparatus to provide a precision graded area.

The method preferably includes a further step of compacting the particulate matter. Preferably this compacting step is performed on the prepared surface area before precision grading.

DETAILED DESCRIPTION

Figure 1:
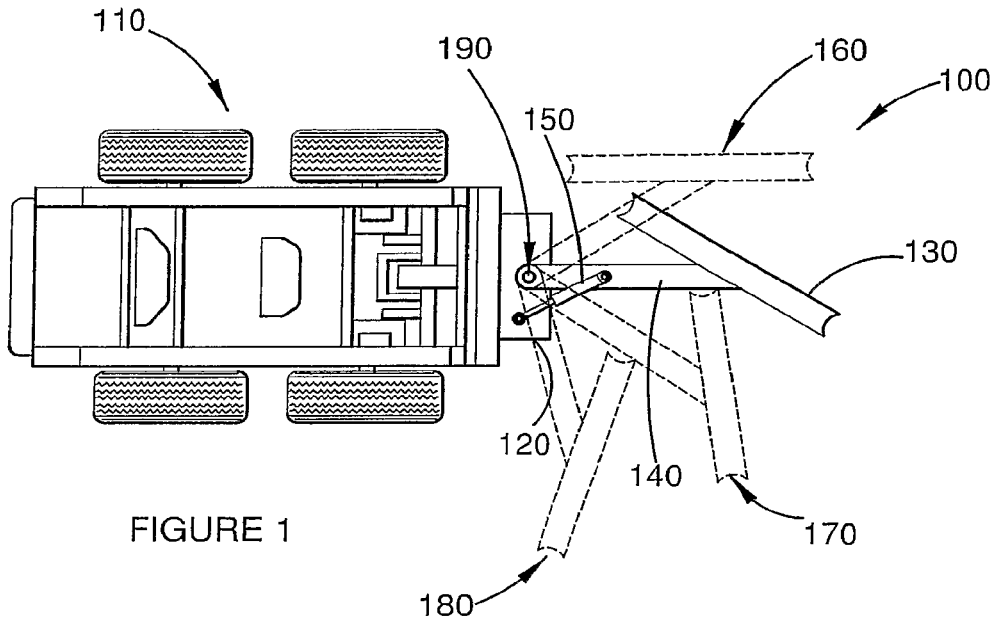
FIG. 1 shows an example of an embodiment of the apparatus of the invention attached to a prime mover.

Embodiments of the present invention provide a method and apparatus for distributing particulate matter over a surface by spreading. An example of the apparatus according to an embodiment of the invention is shown in FIG. 1. The apparatus 100 for distributing particulate matter over a surface is adapted to be fitted to a prime mover 110. The apparatus 100 includes a mounting frame 120 for attaching the apparatus to the prime mover 110, at least one grading blade 130 carried by the mounting frame and mounted moveable laterally sideways relative to the prime mover 110 and an actuator 150 to controllably move the grading blade to move the grading blade substantially sideways relative to the prime mover.

In the embodiment of FIG. 1 the grading blade 130 is shown attached to an arm 140 which is pivotally mounted to a pivot 190 on the mounting frame 120. The actuator 150 is a hydraulic ram and extension or contraction of the hydraulic ram causes the arm 140 to swing about the pivot to move the grading blade 130 laterally sideways relative to the prime mover 110. Examples of positions the grading blade can be moved to are represented in dotted lines 160, 170, 180.

The grading blade 130 may be fixed in position on the arm 140 or the angle of the position of the grading bade 130 on the arm 140 may be adjustable by manual adjustment, and locked into place so it is fixed in position while in use. Alternatively, a second actuator (not shown) may be provided to enable the angle of the position of the grading blade 130 relative to the arm 140 to be adjusted dynamically during use. The vertical angle of the grading blade may also be adjustable.

The apparatus is used to distribute particulate matter by spreading, such as sand, soil, stones, crushed rock, concrete, asphalt etc. To spread the particulate matter the grading blade 130 is positioned in engagement with the particulate matter and the prime mover 110 moved in a direction of travel, generally directly forwards or backwards, so that some of the particulate matter is spread over an area of the surface as the grading blade 130 is dragged over this area by the prime mover 110. The shape of this area is defined by a combination of the movement of the prime mover 110 and the sideways movement of the grading blade 130 relative to the direction of travel of the prime mover. The sideways movement of the grading blade 110 enables the outer side edges of the area to be contoured by the movement of the grading blade. Thus, the side edges of the area to be graded to each side of the apparatus can be varied without changing the direction of travel of excavation equipment. This is of particular advantage in application where areas to be graded are awkwardly shaped, such as landscape gardening applications, or where it is difficult for prime movers to manoeuvre such as along walls or into corners, for example grading a sand pad for concrete laying inside a building shell.

Being able to adjust the position of the grading blade sideways relative to the direction of travel of the prime mover means the grading blade can be run along a wall, using the wall as a guide, without any danger of jamming, which could otherwise occur in known prior art apparatus where the blade is rigidly fixed laterally relative to the prime mover. Using the apparatus of embodiments of the present invention the driver of the prime mover can control the position of the grading blades relative to the wall and adjust the position of the grading blades so that it grades along the wall even if the prime mover is not travelling directly parallel to the wall. Thus, less area along the wall is left ungraded requiring manual finishing or reducing the risk of the grading blades scrapping or jamming against the wall. Alternatively, swinging the grading blades could enable a prime mover to follow a linear path and simply swing the grading blade to vary the grading area, such as to avoid trees and shrubs in a landscaping application.

Figure 2:
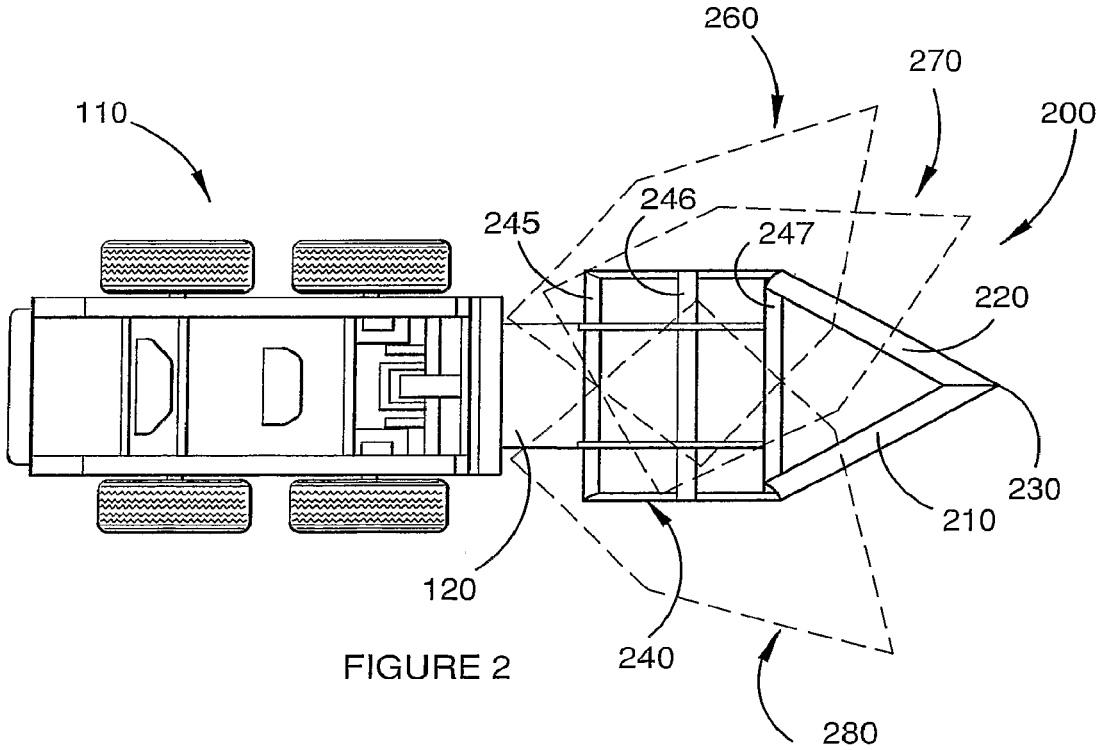
FIG. 2 shows an example of another embodiment of the apparatus of the invention attached to a prime mover.

A preferred embodiment of the apparatus is shown in FIG. 2. The apparatus 200 is mounted on a prime mover 110 using a mounting frame 120 in a manner similarly to the embodiment previously described. However, the apparatus is provided with two grader blades 210, 220 joined at an angle to form a nose 230. The nose 230 is attached to a grading blade frame 240 which is further provided with auxiliary grading blades 245, 246, 247. The frame is pivotally mounted to the mounting frame 120 to enable the frame 240 with its auxiliary grading blades and nose 230 to be moved sideways relative to the prime mover 110. Examples of positions 260, 270, 280 to which the mounting frame can be moved are shown in dotted lines.

Figure 3A:
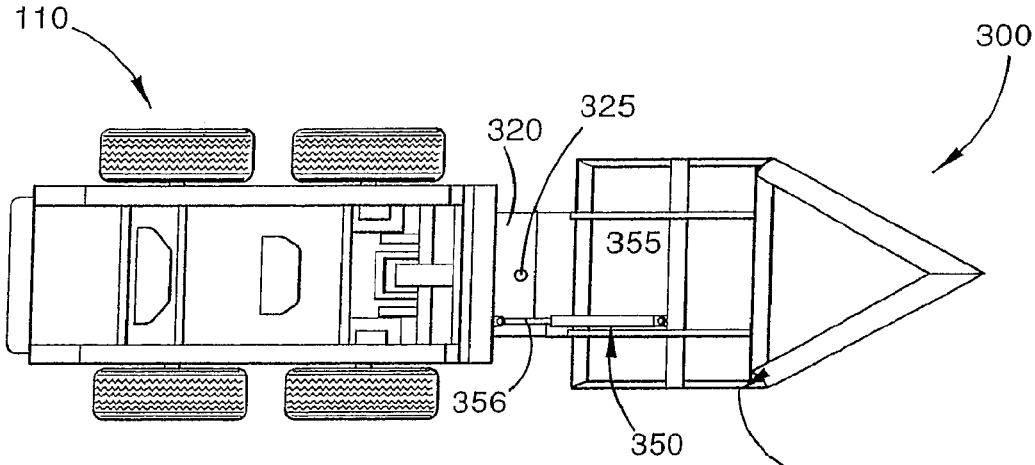
FIGS. 3*a*, 3*b* and 3*c* show examples of lateral sideways movement of the apparatus according to one embodiment of the present invention.
Figure 3B:
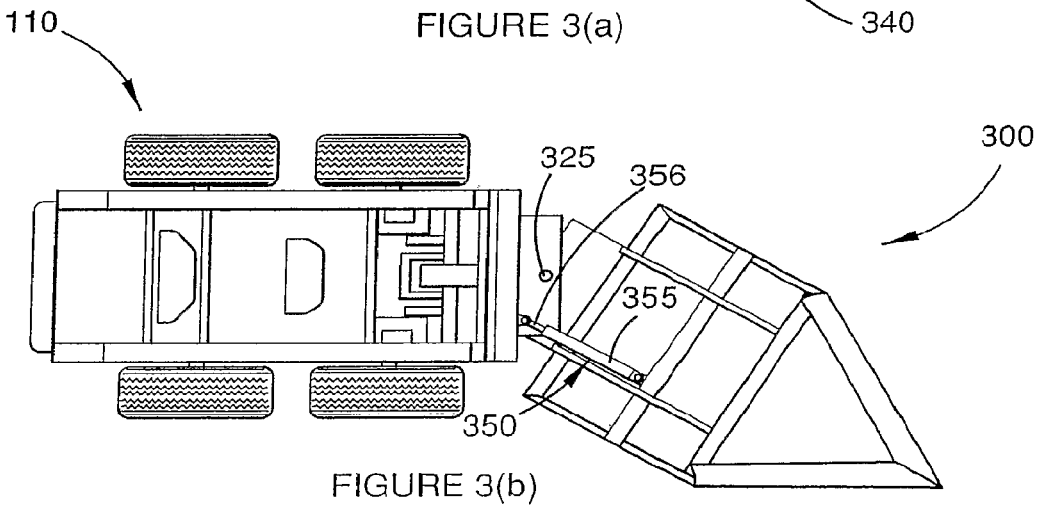
Figure 3C:
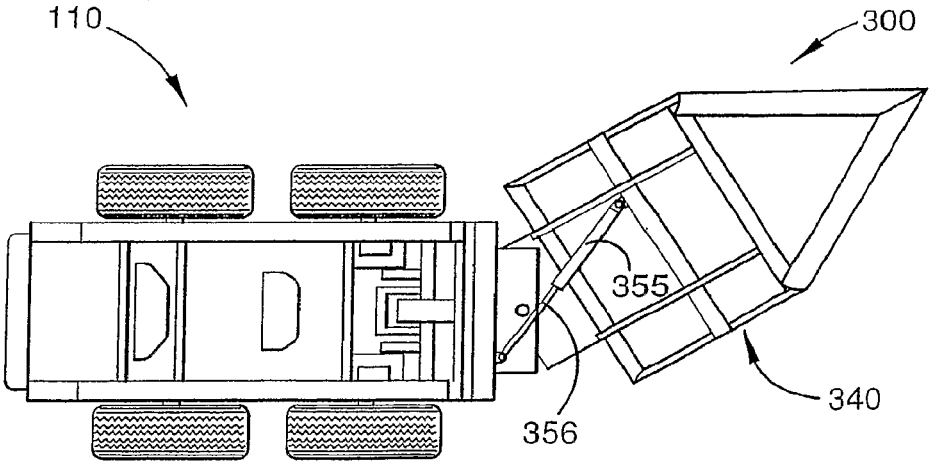

FIGS. 3*a*, 3*b* and 3*c* show an embodiment of the apparatus 300 where the movement of the frame 340 is actuated by a hydraulic ram 350. The apparatus is mounted on the prime mover 110 using mounting frame 320, to connect with the usual linkage mountings and the grading blade frame 340 attached to the mounting frame 320 by pivot mount 325. The hydraulic ram 350 is attached to the mounting frame 320 at one end and to the grading blade frame 340 at the other. Typically, the prime mover is a "Bob Cat" or similar.

Contraction and expansion of the hydraulic ram 350 cause the grading blade frame 340 to swing laterally on the pivot mount 325. For example, as shown in FIG. 3*b*, retracting the arm 365 of the hydraulic ram 350 in to the cylinder 355 causes the hydraulic ram 350 to contract overall which swings the grading blade frame 340 towards the right hand side of the prime mover 110. Conversely, as shown in FIG. 3*c* extension of the arm 356 from the cylinder 355 causes the grading blade frame to swing to the left hand side of the prime mover 110. The hydraulic ram can be controlled dynamically by the operator in the prime mover.

Although the actuator of the preferred embodiment is a hydraulic ram 350, other actuators could be used, such as gears or cogs and chains driven by hydraulics, motors or even manually. The advantage of using a hydraulic ram is that many conventional prime movers are provided with auxiliary hydraulic connections to enable tool hydraulics to be controlled by the driver which can be utilised for the control of the actuator 350.

Figure 4:
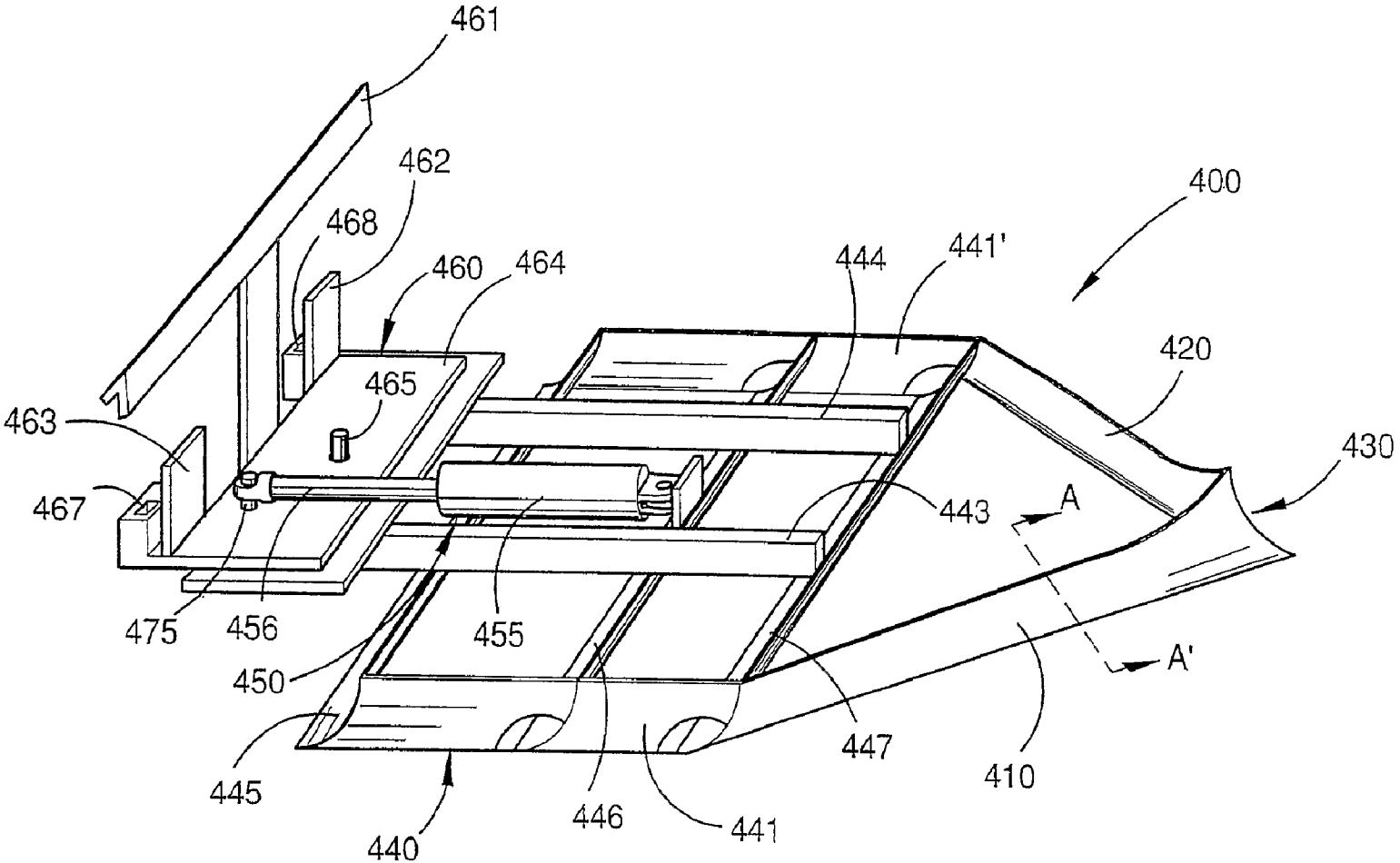
FIG. 4 is an example of an embodiment of the apparatus according to the present invention.

FIG. 4 is an example of a preferred embodiment of the apparatus for use with a prime mover such as a "Bob Cat" or similar. The apparatus 400 includes a grading blade frame 440 and mounting frame 460. The mounting frame provides a first assembly to enable the attachment of the apparatus 400 to a prime mover which is attached to a second assembly which enables the movement of the grading blade frame relative to the prime mover.

The embodiment shown uses a known assembly which enables the attachment of the apparatus 400 to a prime mover which has a front plate. The top edge of the front plate of the prime mover engages with top member 461, and portions of the bottom face of the front plate rest against members 462 and 463. Engagement pins are inserted into apertures 467 and 468 to lock the front plate to the mounting frame 460. The assembly for enabling attachment of the apparatus to a prime mover can be modified to enable attachment to any prime mover. For example, a frame for attachment to a tractor using pins may be used, or a combination assembly which enables the attachment of the mounting frame to more than one prime mover may be used.

In the preferred embodiment, the assembly to enable attachment to the grading blade frame comprises a plate 464 and pivot mount 465. The pivot mount 465 pivotally connects the plate 464 of the mounting frame 460 and the plate 442 of the grading blade frame 440. The actuator 450 is also attached to the mounting frame 460 plate 464 using actuator mount 457 which is laterally offset from the pivot mount 465. The actuator 450 is also connected to the grading blade frame to enable the actuator to work against the grading blade frame 440 and the mounting frame 460 to cause relative moment therebetween. In the embodiment shown, the actuator 450 is a hydraulic ram and, due to the lateral offset between actuator mount 457 and pivot mount 465, extension or retraction of the ram arm 456 into the cylinder 455, will cause the grading frame to swing on the pivot mount 465.

The grading blade frame 440 comprises a plate 442 which attaches to the mounting frame 460, two members 443 and 444 extending from the plate, side members 441 and 441', and (in this embodiment) the auxiliary grading blades 445, 446 and 447 form part of the grading blade frame by joining the two side members 441 and 441' and (in this embodiment) the grading blades 445, 446 and 447 are also attached to arms 443 and 444 which extend from the plate 442. The auxiliary grading blades 445, 446 and 447 are arranged parallel and perpendicular to side members 441, 441', however the angle of the auxiliary grading blades may vary from being perpendicular to the side members as appropriate for the application.

Figure 8:
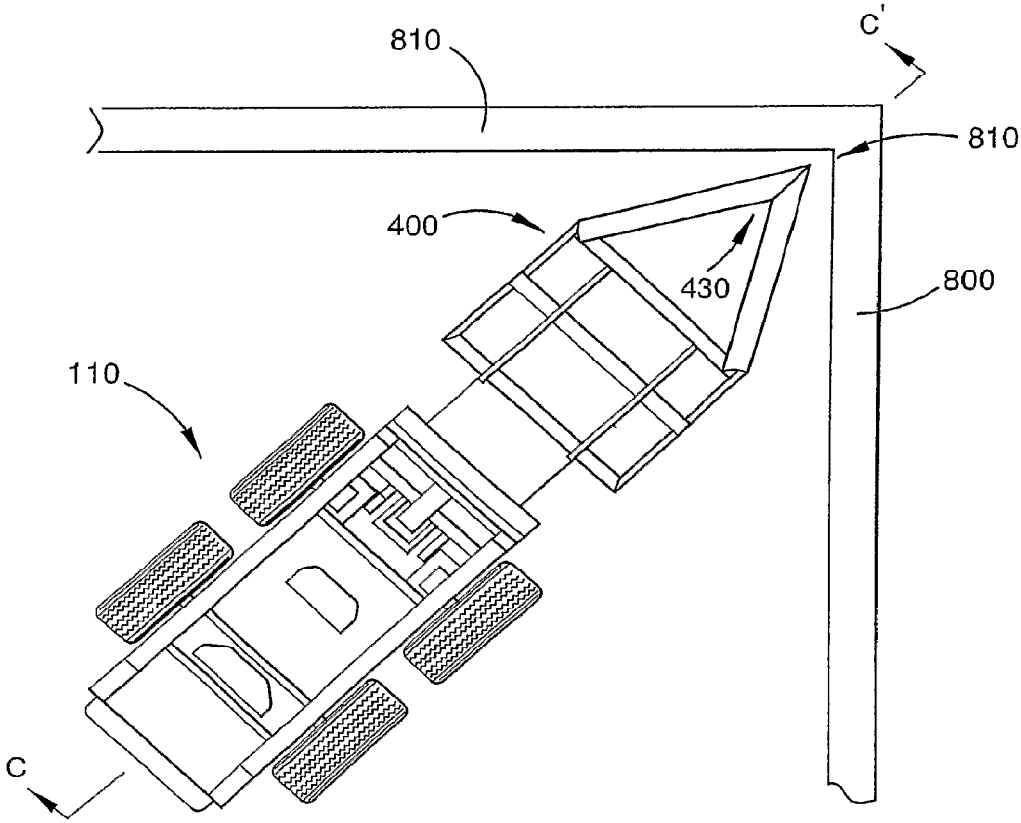
FIG. 8 shows an example of the apparatus of an embodiment of the invention being used to grade into a corner.
Figure 9:
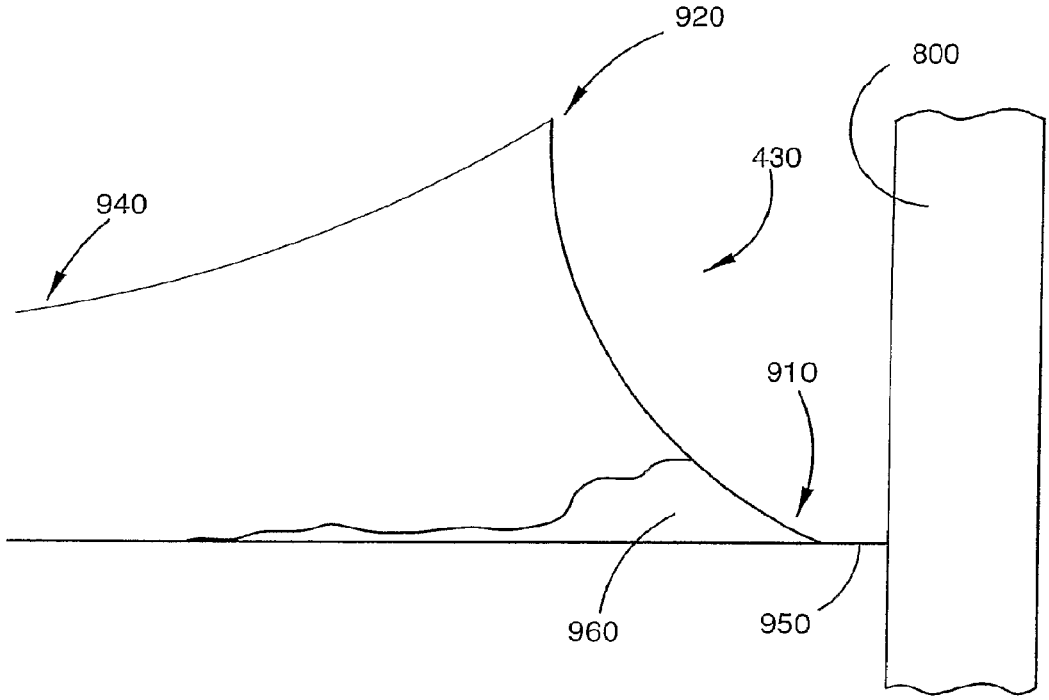
FIG. 9 shows an example in detail of the nose section of the apparatus of FIG. 10 grading into the corner.

Two grading blades 410 and 420 joined at an angle to form anose 430. The blades 410 and 420 are attached to the forward ends of the sides 441 and 441' of grading blade frame 440. Preferably the angle between the grading blades 410 and 420, where they join to form nose 430 is 90° or less than 90° to enable the nose to be manoeuvred into right angled comers, for example, as is shown in FIG. 8 which shows the prime mover 110 positioning the apparatus 400 into a corner 810 formed by two adjacent walls 800 and 801. FIG. 9 illustrates a cross section through line C-C'. of the nose 430 near the wall 800. The nose is shaped so the lower edge portion 910 juts furthest forward to enable this bottom edge portion to reach into the corner against the wall 800, and to be placed on top of the particulate matter. When the prime mover 110 is moved backwards, out the corner, the excess particulate matter 960 accumulates within the nose 430 and is moved backwards along with the nose, leaving the area of the surface 950 in front of the nose 430 level. The upper edge of the grading blade can be made relatively higher in the nose area 920 than along the remainder of the grading blade 940 to provide a greater surface area of the nose portion.

Although in the embodiment of FIG. 4 the grading blades extend form the nose to the frame sides 411 and 411', embodiments are envisaged where the grading blades 410 and 420 extend outwardly beyond the sides 441 and 441'or attach to the frame 440 within the sides 441 and 441'. The embodiment shown is merely one arrangement that could be used and alternatives are envisaged within the scope of the invention.

Figure 6A:
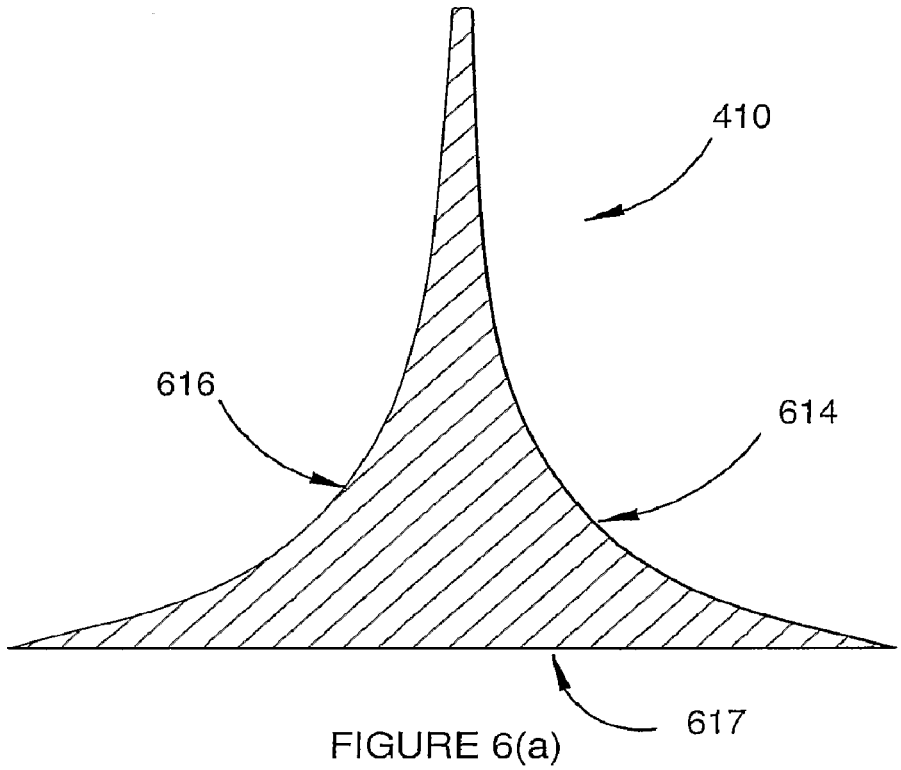
FIG. 6*a* shows an example of a cross section for a grading blade taken through line A-A' of FIG. 4.

The grading blades can be shaped to provide advantageous performance characteristics. For example, in a preferred embodiment the grading blades have a vertical component which is concave, as can be seen in the auxiliary grading blades 445, 446 and 447. The concave vertical component can also be provided on the grading blades 410 and 420 which form the nose 430. One or both sides of the grading blades 410 and 420 can have a concave surface. An example of an embodiment of grading blade 410 provided with two concave vertical components is illustrated in FIG. 6(*a*) which shows a cross section of grading blade 410 through line A-A'. The grading blade 410 has two concave faces 614 and 616 and a flat base 617. The curvature of both faces of the blade 410 enables the blade to grade efficiently using either side of the blade so the blade works as efficiently in the forward direction using face 614 as in the reverse direction using face 616. Further the flat base 617 can be used to apply pressure vertically downwards in an area to pack down the particulate matter, for example to pack down sand in a corner before grading off any excess.

The curvature of the grading blade may also be different on either side of the blade, or vary along the length of the blade. For example, for grading blade 410 the curvature of the inner face 616 may be more concave than that of the outer face 614, or the curvature of the inner face may be more concave in the nose region of the blade 410 than in the region where the blade joins the grading blade frame. It should be appreciated that each grading blade may have different curvature. Further none, only some or all grading blades may have two concave faces.

Figure 10A:
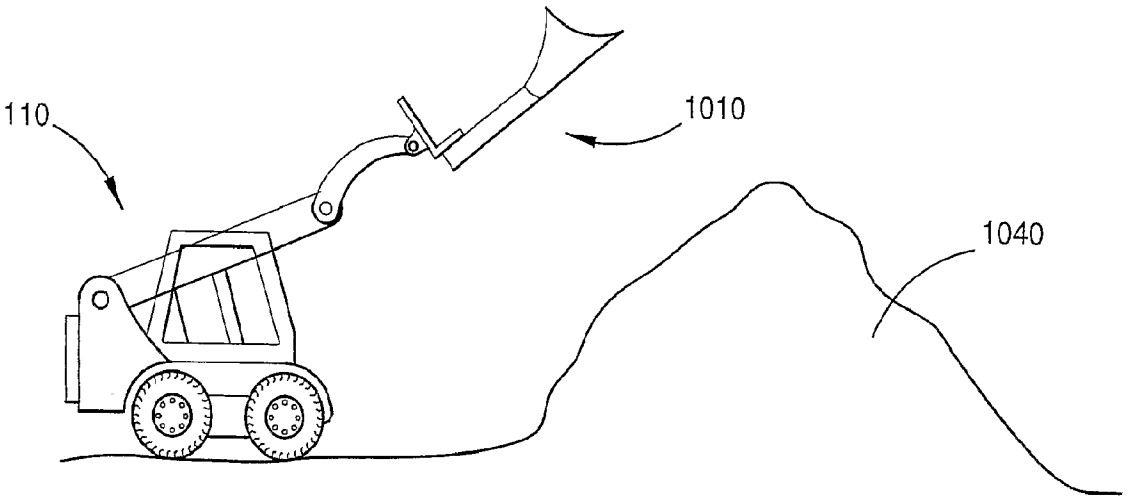
FIGS. 10*a* and 10*b* show an example of the apparatus of an embodiment the present invention being used on a mound.
Figure 10B:
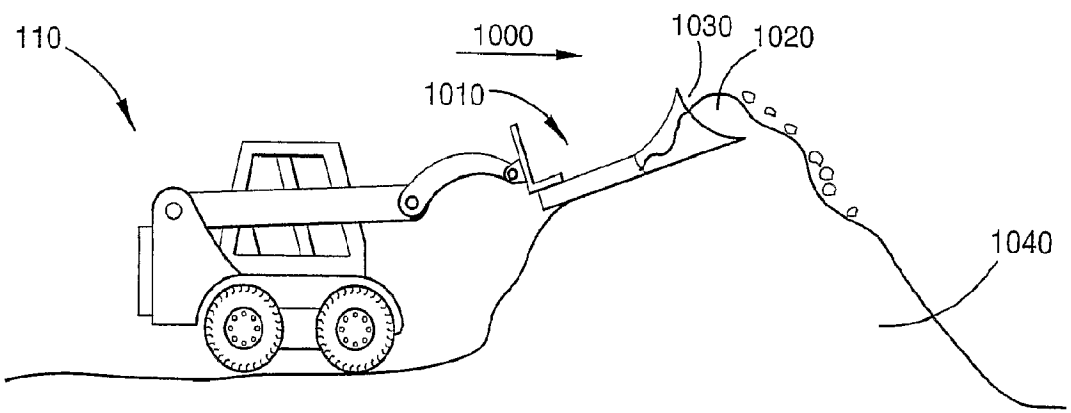
Figure 11A:
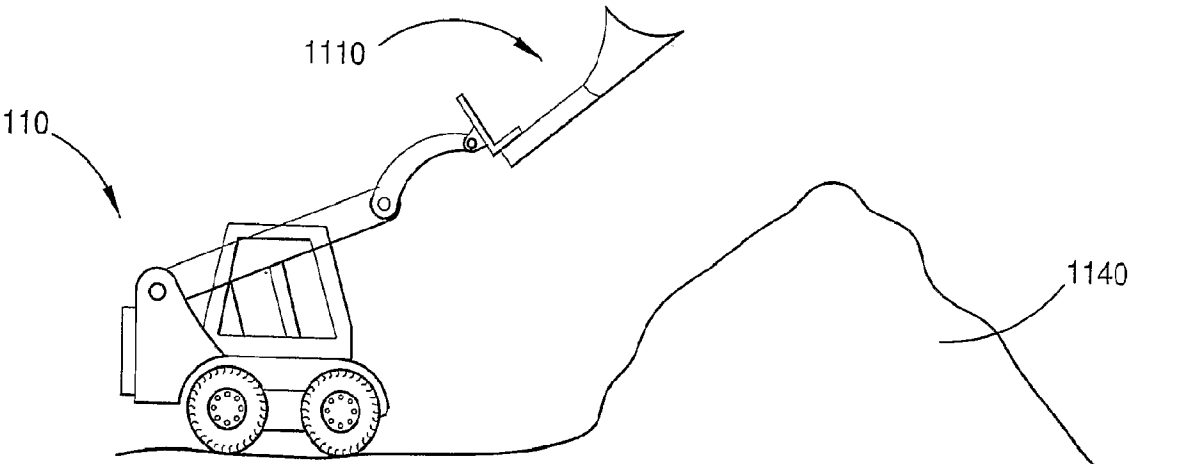
FIGS. 11*a* and 11*b* show a further example of the apparatus of an embodiment of the present invention being used on a mound.
Figure 11B:
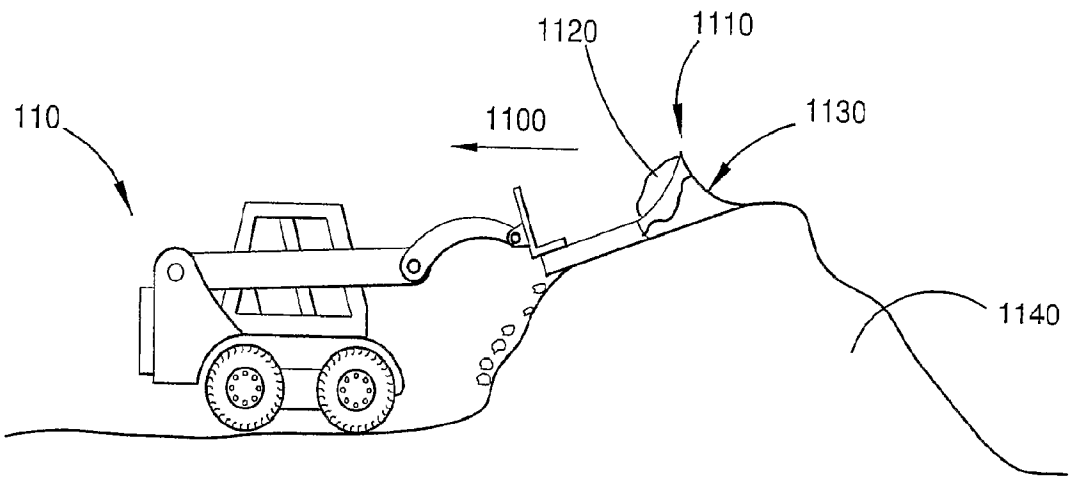

The upper edge of the grading blades 410 and 420 can be made substantially higher near the nose 430 than where the blades join the frame 440. Such an embodiment can enable the particulate matter to accumulate to a greater height in the nose region 430 than along the length of the grading blades 410 and 420. Additional height in the nose region can be advantageous when the nose 430 is being used to push particulate matter in a forward direction. The advantage of the extra height of the grading blades in the nose region can be observed in Figures 10*a*, 10*b*, 11*a* and 11*b* where the apparatus is being used to distribute particulate matter from a mound. In FIG. 10 the nose 1030 is pushed into the mound 1040 by the forward motion 1000 of the prime mover 110. The particulate matter 1020 accumulates on the nose 1030 and is pushed forward. The operation in the opposite direction is shown in FIG. 11. The apparatus 1110 is lowered onto the mound into engagement with the particulate matter by the prime mover 110. Movement of the prime mover in the reverse direction 1100 causes particulate matter 1120 to accumulate inside the nose 1130 and be dragged backwards off the mound 1140.

Figure 5:
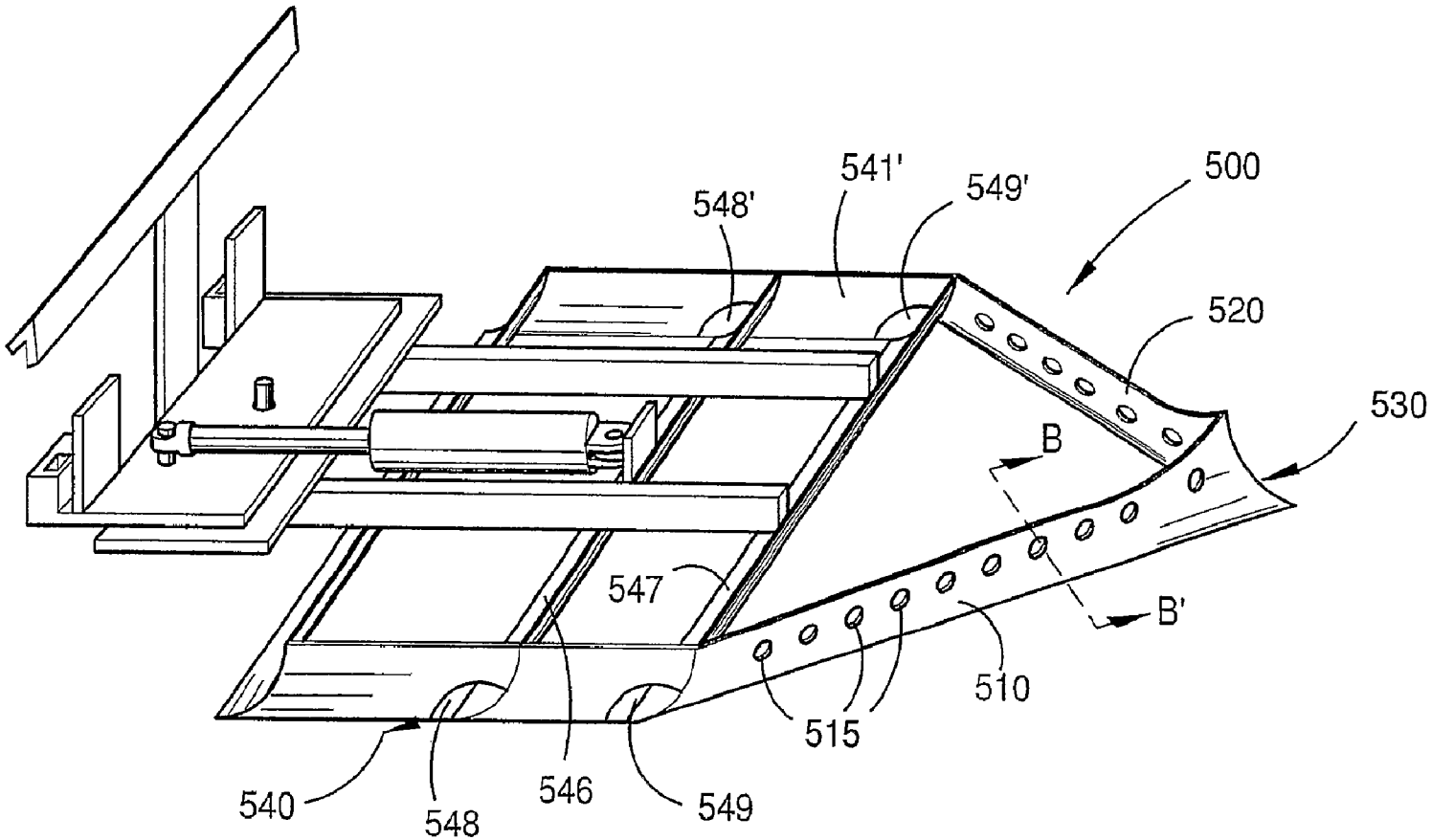
FIG. 5 is an example of an alternative embodiment of the apparatus according to the present invention.

An alternative embodiment of the apparatus is shown in FIG. 5. This embodiment is similar to the embodiment of FIG. 4 and includes additional optional features which may be advantageous in some applications. The grading blades are attached to a grading blade frame 540. Apertures 548, 548', 549 and 549' are formed in the sides 541 and 541' of the frame adjacent the auxiliary grading blades 546 and 547. The apertures enable particulate matter accumulated on the grading blades 546 and 547 to pass through the frame, thus reducing the amount of particulate matter accumulated on the grading blades 546 and 547 within the frame. The grading blades 510 and 520 forming the nose 530 can also be provided with apertures 515 therethrough. These apertures 515 enable a portion of the particulate matter to pass through the blades. This can be desirable in an application such as preparing a surface for further grading using a precision tool. For example, the grading blades substantially level the surface, however a layer of the particulate matter, which passes through the blades, is left behind for the precision grader to work with.

Figure 6B:
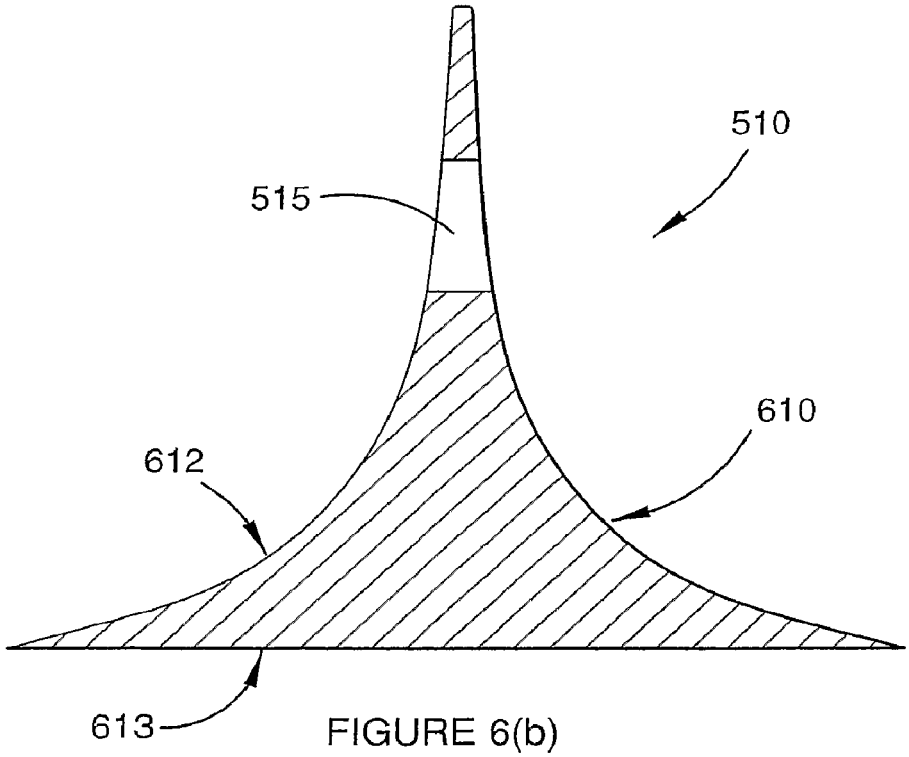
FIG. 6*b* shows an example of a cross section for a grading blade taken through line B-B' of FIG. 5.

An example of the cross section of grading blade 510 through line B-B' is shown in FIG. 6*b*. The grading blade has a flat base 613 and two concave faces 610 and 620 with the aperture 515 formed therein. In the embodiment shown the grading blade 510 is solid, however it could also be hollow, with a sleeve forming an aperture wall, or some other structure used to prevent or limit particulate matter accumulating inside the blade. The position, size and/or shape of the apertures in the blade may also be varied to suite the particular application of the blade.

The shape and material from which the grading blade is constructed may vary depending on the application for the apparatus. For example, the grading blade may be formed from solid hard material, such as metal or hard plastics, or the inside of the blade may be hollow, say formed from sheets of metal welded together. Alternatively, the blade could be constructed as a hollow shell and filled with matter such as plastic, foam, lattice or rib type structure or the like to strengthen the blade. For embodiments where apertures are formed in a hollow blade a structure such as a moulded plastic insert could be provided inside the blade to prevent or limit accumulation of particulate matter inside the blade, such an insert may also be made moveable to enable the apertures to be blocked or closed by the insert.

Figure 7:
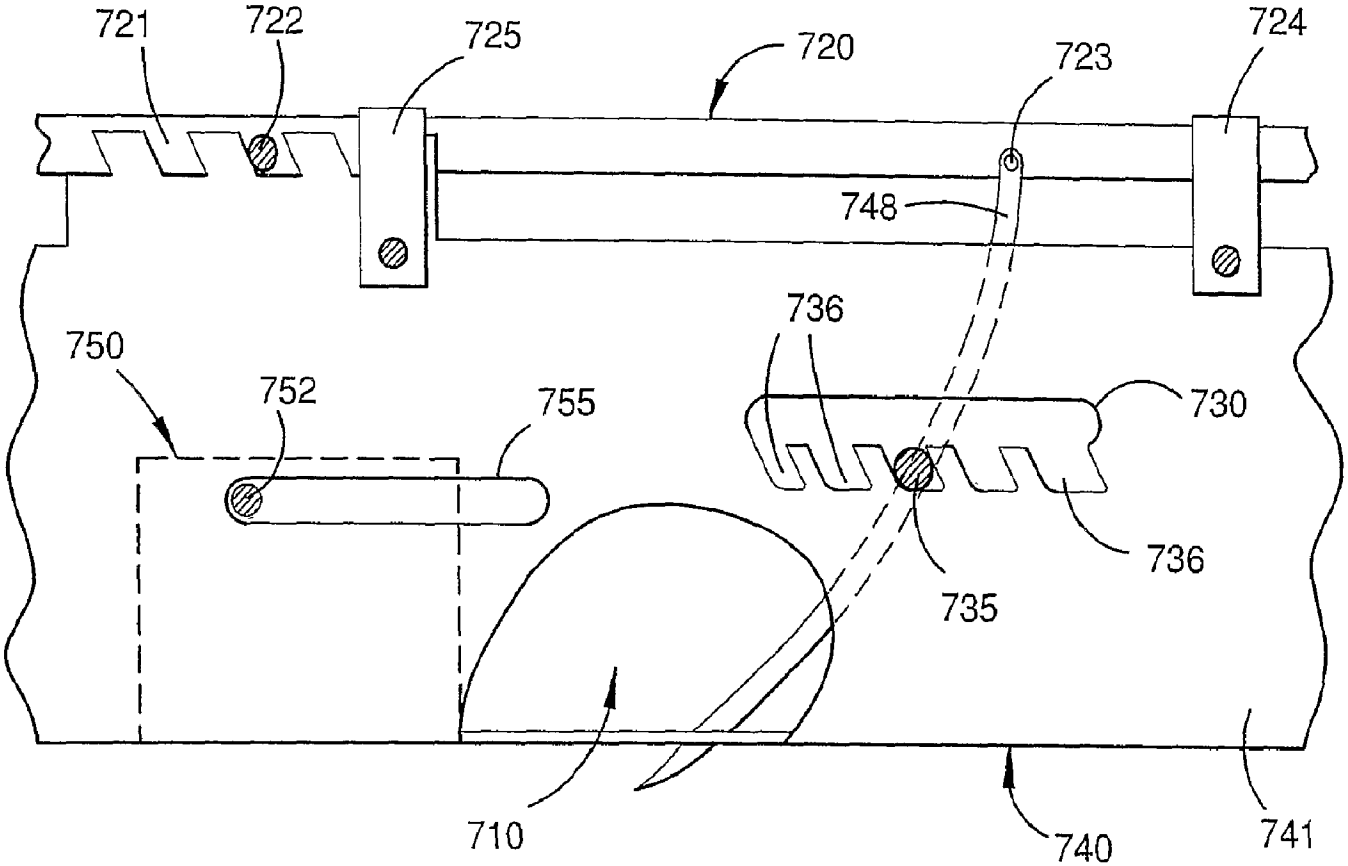
FIG. 7 shows an example of an embodiment of grader blade adjustment feature.

Examples of some optional features which enable adjustments such as modifying the angles of the grading blades and closing of apertures are shown in FIG. 7. The auxiliary grading blade 748 has posts 735 extending horizontally from each end of the grading blade 748. Mounting apertures 730 are provided in each side 741 of the mounting frame to receive the posts 735 to mount the grading blade in the frame 740.

Each mounting aperture can be provided with one or more grooves each adapted to receive the post 735. The angle of the grading blade across the frame 740 in the horizontal plane can be adjusted by placing the posts 735 on each end of the grading blade 748 in different grooves. For example, where both posts 735 are placed in two grooves which are aligned perpendicularly across frame 740, the grading blade 748 will be perpendicular to the frame and placing the posts in grooves which are offset from each other will result in the grading blade being angles across the frame and the degree of angle is varied by the amount of offset between the two grooves. As is shown in FIG. 7 the mounting aperture 730 may have a plurality of grooves 736.

The angle of the grading blade 748 in the vertical plane can also be adjustable. In the embodiment of FIG. 7 the upper edge of the grading blade 748 is pivotally attached at 723 to an adjusting rod 720 and the post 735 provides a pivotal mount in the frame such that movement of the adjusting rod forward or back will cause the grading blade 748 to rotate about the pivot and hence change the angle of the blade 748 in the vertical plane. To hold the adjusting rod 720 in position to prevent movement of the blades any number of mechanisms may be used. In the embodiment shown the frame 740 has adjusting grooves 721 for receiving a projection 722 from the rod 720 wherein the angle of the blades will vary depending on the groove 721 used. The adjusting grooves 721 limit movement forward and backward movement of the rod. Locking brackets 724 and 725 can also be provided to enable the rod to be secured in position and prevent vertical movement of the rod which, in turn, prevents vertical movement of the grading blades thus also preventing disengagement of the post 735 from the mounting grooves 736.

The embodiment of FIG. 7 also shows one embodiment of the movable cover 750 for an aperture 710 in the side 741 of the mounting frame 740. As described above, the aperture 710 allows particulate matter accumulated on the grading blade to pass through the frame, however, this may not be desirable for all applications or the user may wish to limit the amount of particulate matter able to pass thorough the frame. The cover 750 as shown can be slid across the aperture 710 using a handle 752 retained in a guide 755 to partially or fully close the aperture 710. Each cover may be operated individually or alternatively covers for each aperture may be connected or simultaneously controlled such that all covers will be moved in response to a single control operation. There are many possible ways in which to implement the features of the apparatus all envisaged within the scope of the present invention. The embodiments shown merely illustrate possible ways of implementing the preferred features.

In an alternative embodiment the grading blade assembly may be integral with the prime mover rather than being a removable attachment. A grading blade assembly may be provided permanently attached to a ride on prime mover, such as a "bob cat", tractor or similar prime mover.

Alternatively a lightweight prime mover provided with the grading blade assembly may be particularly advantageous for use in applications such as smoothing and surface finishing of poured concrete. A prime mover having a sufficient surface area contact footprint can be supported by a semi solid material, such as wet concrete, newly laid ashphalt or mud. Thus an apparatus of the present invention can be used as a smoothing and finishing tool for applications using semi solid material, such as finishing a poured concrete slab or smoothing and repairing a disturbed and muddy area of a sports arena.

An embodiment of the apparatus dedicated for applications such as finishing concrete surfaces is envisaged comprising a lightweight prime mover having a an attached grader blade assembly, preferably the movement of the prime mover and the grading blade assembly can be controlled remotely, for example using short range radio frequency signals, or be automatically controlled to avoid needing to support the weight of the driver on the apparatus. A combination of remote and automatic control may be used. For example, a radio frequency remote control module similar to that used in remote control cars and children's toys may be used to control the movement of the prime mover, and a laser guided control used to control the movement of the grading blade assembly. Such an embodiment has a significant advantage over manual finishing of particulate matter surfaces, such as finishing a concrete slab, as disruption to the particulate matter being finished is minimised by minimising the weight required to be supported and avoiding indentations caused by a person moving over an area such as foot or hand prints which need to be subsequently smoothed.

An alternative embodiment is envisaged which also enables the grading blade frame to be tilted laterally in the vertical plane, for example by rotation about an axis through the horizontal swing pivot mount and the point of the node of the grading blade assembly. Alternatively the tilt may be achieved by rotating about an axis through one side of the grading blade frame such that one side of the grading blade assembly is raised or lowered relative to a fixed level of the opposite side. Separate actuators may be provided to enable each of the horizontal swing and vertical tilt. The mounting assembly may provide separate pivot mounts to enable each of the horizontal swing and vertical tilt or a universal joint mounting may be provided enabling both the horizontal swing and vertical tilt.

In combination with the horizontal swing of the grading blade assembly this feature enables the grading blade to be used to grade a surface angled relative to the direction of travel of the prime mover. For example, a the side of a ditch may be graded by angling the grading blade assembly into the ditch and moving the prime mover parallel to the direction of travel of the ditch. Such embodiments can be advantageously applied in applications such as landscape gardening or construction where contoured surfaces are desired.

The ability to laterally adjust the position of the grading blades relative to the prime mover has particular advantages for operating is restricted areas, such as into comers and along walls. This feature also enables an advantageous method for spreading particulate matter when used in conjunction with a second prime mover with a precision grading tool attached. As discussed above the accuracy of a precision grading tool, such as a laser grading tool, can be compromised by excess weight on the grading blade, and the area graded also limited manoeuvrability of the precision grading tool. It is proposed to improve the performance of the precision grading tool by minimising the amount of particulate matter it is required to distribute and improve the overall finish of the grading job by using the apparatus of embodiments of the present invention to finish areas unable to be accessed by the precision grader.

One or more first prime movers for spreading particulate matter are provided. Preferably each first prime mover is provided with a grading blade assembly as described above. These first prime movers spread particulate matter over the surface such that it is substantially level to prepare the surface for further grading using a second prime mover provided with a precision grading tool, which grades the prepared surface area, leaving a precision graded area.

As the surface has been prepared to be substantially level prior to grading by the precision grader, the amount of particulate material and its associated weight on the precision grader blade is minimised, thus improving the accuracy of the precision grading. Optionally the surface can be further prepared for the precision grading by compacting the particulate matter after it is spread over the surface by the first prime movers.

The area adjacent the precision graded area which has not be graded by the precision grader, for example because it could not be reached by the blade of the precision grading tool, is then graded by the first prime movers based on the level of the precision graded area. For example, the first prime mover 110 places the apparatus 100 level on at least part of the surface graded by the precision grader so that the blades of the apparatus will grade at the same level as the precision grader. The apparatus 100 is then moved using a combination of the movement of the prime mover and the lateral movement of the apparatus to grade the area adjacent to the precision graded area to the same level as the precision graded area. As the surface was prepared ahead of the precision grader to be substantially level, only a relatively small amount of particulate matter should be required to be spread by the first prime movers to finish the surface and thus there is minimal impact on the precision graded area due to the finishing.

Use of this method with a precision laser grader has shown that a sand pad for laying concrete can be graded having a surface level to within 2 mm tolerance of the desired level. In contrast typical tolerance for a sand pad using a laser grader alone is around 10 mm and can be greater. Manually prepared sand pads can have a surface level variation in excess of 50 mm.

There are two significant impacts the quality of a sand pad can have on the subsequent concrete laying. Firstly the amount of concrete required to achieve the desired height for the slab can increase significantly if the sand pad is not level, typically concrete contractors estimate and figure into costs an additional 6% to 10% concrete above the theoretical volume required for the slab to compensate for sand pad variation. Thus the excess material and associated costs can be minimised by minimising the variation in sand level.

Secondly variations in the level of the sand pad result in corresponding variations in the thickness of the concrete slab laid upon it. Earth movement or temperature and humidity variation can cause concrete to crack and concrete will typically crack where it is thinnest and therefore weakest. Typically score lines of around 5 mm depth will be made in a concrete slab, each designed to provide a weak point aiming control where cracks will occur when the inevitably do. However, variations in the level of the sand pad base of even 5 mm can result in the concrete slab being thinner in areas away from the score lines and hence the slab may not crack along the score lines as desired. Further the variation of the sand pad produces stronger and weaker areas in the concrete slab due to the variation in thickness, and the weaker areas will be relatively weaker than compared to a slab having an even thickness, thus these relatively weaker areas are more likely to crack than a slab having even thickness. Thus the more level the sand pad the less likely the slab is to crack and the more predictably the slab will crack when it does.

Figure 12:
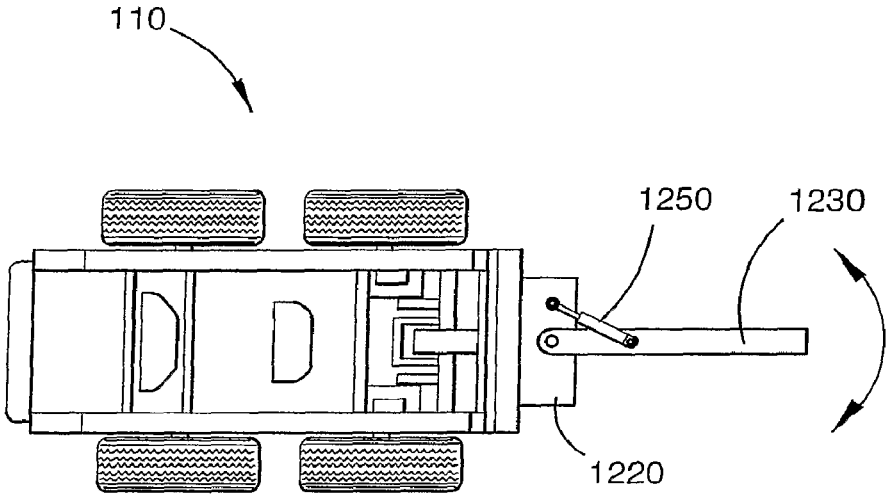
FIG. 12 shows an example of a simplified embodiment of the apparatus according to the present invention.

A simplified embodiment of the apparatus is shown in FIG. 12. This embodiment comprises a mounting frame 1220, a single grading blade 1230 and an actuator 1250. The grading blade 1230 is pivotally mounted on the mounting frame 1220, such that the actuator 1250 causes the grading blade 1230 to swing laterally sideways.

In the claims which follow and in the preceding description, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. An apparatus for distributing particulate matter over a surface, said apparatus being adapted to be fitted to a prime mover, the apparatus comprising:

a mounting frame for attaching the apparatus to the prime mover;

a grading blade assembly comprising a grading blade frame, and mounted to the grading blade frame two grading blades joined at an angle of less than 90° to form a nose at the forward end of the apparatus relative to the mounting frame, the grading blade frame being carried by the mounting frame and pivotally mounted relative to the mounting frame by a single pivot on the centerline of the mounting frame to enable the grading blade assembly to swing about the pivot to move the grading blades laterally relative to the prime mover; and single linear actuator arranged offset from the centerline of the of the mounting frame to controllably move the grading blade assembly to swing the grading blade assembly laterally relative to the prime mover.

2. An apparatus as claimed in claim 1 wherein each grading blade has a vertical grading component that is concave.

3. An apparatus as claimed in claim 2, wherein each grading blade has a left hand side grading face and a right hand side grading face and wherein each grading face has a vertical grading component that is concave.

4. An apparatus as claimed in claim 1 further comprising one or more auxiliary grading blades mounted between the grading blade and the mounting frame.

5. An apparatus as claimed in claim 1 wherein the actuator is a hydraulic ram.

6. An apparatus as claimed in claim 1 wherein the grading blade frame has apertures proximate each auxiliary grading blade to enable a portion of the particulate matter being graded to pass therethrough.

7. An apparatus as claimed in claim 1, wherein the grading blade is provided with apertures to enable a portion of the particulate matter being graded to pass therethrough.

8. A method for spreading particulate matter over a surface comprising the steps of:

providing one or more first prime movers each with an apparatus comprising:

a mounting frame for attaching the apparatus to the prime mover;

a grading blade assembly comprising a grading blade frame, and mounted to the grading blade frame two grading blades joined at an angle of less than 90° to form a nose at the forward end of the apparatus relative to the mounting frame, the grading blade frame being carried by the mounting frame and pivotally mounted relative to the mounting frame by a single pivot on the centerline of the mounting frame to enable the grading blade assembly to swing about the pivot to move the grading blades laterally relative to the prime mover; and a single linear actuator arranged offset from the centerline of the of the mounting frame to controllably move the grading blade assembly to swing the grading blade assembly laterally relative to the prime mover;

positioning the grading blade assembly in engagement with the particulate matter; and swinging the grading blade assembly laterally sideways relative to the prime mover to move the particulate matter independent of movement of the prime mover.

9. A method as claimed in claim 8 further comprising: positioning the nose of the grading blade assembly into a corner using a lateral sideways movement of the grading blade assembly; and moving the prime mover in a direction substantially parallel to a wall forming the corner to spread particulate matter evenly along an edge of the wall from the corner.

10. A method as claimed in claim 8, wherein the method is used to spread particulate matter over a surface to be substantially level to prepare a surface area for further grading using a second prime mover provided with a precision grading apparatus.

11. A method as claimed in claim 10 further comprising a step of compacting the particulate matter of the prepared surface area.

12. A method as claimed in claim 10 further comprising the step of:

grading the prepared surface area using a precision grading tool of the second prime mover to provide a precision graded area.

13. A method as claimed in claim 12 further comprising the step of:

grading an area adjacent the precision graded area not graded by the second prime mover using one or more of the first prime movers.

14. A method as claimed in claim 13, wherein the level of the adjacent area is graded substantially level with the precision graded area based on the level of the precision graded area.

15. A method of spreading particulate matter over a surface comprising the steps of:

providing one or more first prime movers each with an apparatus comprising:

a mounting frame for attaching the apparatus to the prime mover;

a grading blade assembly comprising a grading blade frame, and mounted to the grading blade frame two grading blades joined at an angle of less than 90° to form a nose at the forward end of the apparatus relative to the mounting frame, the grading blade frame being carried by the mounting frame and pivotally mounted relative to the mounting frame by a single pivot on the centerline of the mounting frame to enable the grading blade assembly to swing about the pivot to move the grading blades laterally relative to the prime mover; and a single linear actuator arranged offset from the centerline of the of the mounting frame to controllably move the grading blade assembly to swing the grading blade assembly laterally relative to the prime mover;

positioning the grading blade in engagement with the particulate matter;

moving the prime mover to move the particulate matter to be substantially level to prepare a surface area for further grading;

precision grading the prepared surface area using a second prime mover provided with a precision grading apparatus to provide a precision graded area.

16. A method as claimed in claim 15 including a further step of compacting the particulate matter.

17. A method as claimed in claim 16 wherein the compacting step is performed on the prepared surface area before the precision grading step.

* * * * *